US012485466B2

(12) United States Patent
Yuan et al.

(10) Patent No.: US 12,485,466 B2
(45) Date of Patent: Dec. 2, 2025

(54) APPARATUS AND METHOD FOR DEEP DRAWING OF LARGE-SIZED THIN-WALL CURVED SURFACE PARTS WITH SERVO REVERSE BULGING

(71) Applicant: Harbin Institute of Technology, Harbin (CN)

(72) Inventors: Shijian Yuan, Harbin (CN); Wei Liu, Harbin (CN)

(73) Assignee: Harbin Institute of Technology, Harbin (CN)

( * ) Notice: Subject to any disclaimer, the term of this patent is extended or adjusted under 35 U.S.C. 154(b) by 343 days.

(21) Appl. No.: 17/603,954

(22) PCT Filed: Jul. 23, 2021

(86) PCT No.: PCT/CN2021/108086
§ 371 (c)(1),
(2) Date: Feb. 24, 2023

(87) PCT Pub. No.: WO2022/142292
PCT Pub. Date: Jul. 7, 2022

(65) Prior Publication Data

US 2023/0173567 A1 Jun. 8, 2023

(30) Foreign Application Priority Data

Jan. 4, 2021 (CN) ..... 202110003467.1

(51) Int. Cl.
*B21D 37/10* (2006.01)
*B21D 22/20* (2006.01)
(Continued)

(52) U.S. Cl.
CPC ..... *B21D 37/10* (2013.01); *B21D 22/205* (2013.01); *B21D 22/22* (2013.01); *B21D 37/16* (2013.01); *B21D 51/44* (2013.01)

(58) Field of Classification Search
CPC ..... B21D 37/10; B21D 37/16; B21D 22/20; B21D 22/24; B21D 22/22; B21D 22/26;
(Continued)

(56) References Cited

U.S. PATENT DOCUMENTS

2013/0255349 A1* 10/2013 Lee ..... B21D 7/06 72/414
2017/0326612 A1* 11/2017 Alpen ..... B21D 24/04
(Continued)

FOREIGN PATENT DOCUMENTS

DE 102010060103 B4 * 4/2013 ..... B21D 22/20

OTHER PUBLICATIONS

DE 102010060103 B4 Espacenet English Translation of Description (Year: 2013).*

*Primary Examiner* — Teresa M Ekiert
(74) *Attorney, Agent, or Firm* — LANWAY IPR SERVICES; Chun-Ming Shih

(57) ABSTRACT

Disclosed are an apparatus and a method for deep drawing of large-sized thin-wall curved surface parts with servo reverse bulging, which pertain to the technical field of drawing of a thin-wall curved surface part. The apparatus includes a forming die, a jacking unit, and a power unit, wherein the forming die includes an upper die, a lower die, and a blank holder. The upper die and the blank holder are connected to a press machine, the blank holder is disposed above the lower die, and a blank to be drawn is placed between the lower die and the blank holder; the jacking unit is disposed inside the lower die and adapted to move along a moving direction of the upper die, enabling the blank to be drawn to deform by with reverse bulging. The method can inhibit defects of wrinkling and cracking in drawing processes effectively.

14 Claims, 9 Drawing Sheets

(51) Int. Cl.
*B21D 22/22* (2006.01)
*B21D 37/16* (2006.01)
*B21D 51/44* (2006.01)

(58) Field of Classification Search
CPC ..... B21D 22/06; B21D 24/04; B21D 24/06; B21D 24/08; B21D 24/10
See application file for complete search history.

(56) References Cited

U.S. PATENT DOCUMENTS

| | | | | |
|---|---|---|---|---|
| 2019/0084026 | A1* | 3/2019 | Tsunekawa ..... | B21D 24/02 |
| 2019/0160517 | A1* | 5/2019 | Turner ..... | B21D 22/24 |

* cited by examiner

APPARATUS AND METHOD FOR DEEP DRAWING OF LARGE-SIZED THIN-WALL CURVED SURFACE PARTS WITH SERVO REVERSE BULGING

TECHNICAL FIELD

The invention relates to the technical field of forming thin-wall curved surface parts, and more particularly, to an apparatus and a method for deep drawing of large-sized thin-wall curved surface parts with servo reverse bulging.

BACKGROUND ART

A suspended area of a conventional thin-wall curved surface part is prone to wrinkling and cracking in the process of cold drawing and hot drawing. To overcome the defects, a method of liquid-filled drawing is applied in the prior art, where a liquid-filled cavity is provided in a lower die cavity, a sheet covers the top of the liquid-filled cavity, an upper die moves towards the bottom of the liquid-filled cavity perpendicular to the sheet, and the sheet is drawn with support from a high-pressure fluid. Effective in inhibiting the defect of wrinkling in the plate forming process though, this method causes an excessive drawing load due to the action of the liquid counterforce, which brings about additional equipment tonnage and the manufacturing cost significantly. Another method in the prior art provides an up-and-down arrangement of a plurality of annular sleeves and oil cylinders in combination in a die so that a deformation area of a blank to be drawn is adjusted at multiple points, an arc-shaped surface is formed on a surface, facing an upper die, of the blank to be drawn, and a drawing rib is formed in a suspended area of the blank to be drawn. Such a method can effectively inhibit the problem wrinkling of the suspended area in the drawing process of the blank to be drawn, replaces the liquid counterforce to a certain extent, and reduces the drawing load. However, additional annular sleeves and hydraulic oil cylinders are required in the die, but there is only quite limited space for the installation of the large-tonnage oil cylinders. Moreover, the multi-stage coordination and accurate control of the hydraulic control system is challenging; the plurality of oil cylinders apply an external force to the suspended area of the sheet, which causes uneven stress experienced by the suspended area of the blank to be drawn. As a result, the suspended area is easily thinned and cracked locally, and the process control is more difficult.

SUMMARY OF THE INVENTION

It is an objective of the invention to solve at least one of the problems of easy wrinkling, cracking, excessive drawing load, and high costs or other difficulties in the forming process of a large-sized thin-wall curved surface part in the prior art.

To achieve the above objective, the invention provides an apparatus for deep drawing of large-sized thin-wall curved surface parts with servo reverse bulging, including:

a forming die, a jacking unit, and a power unit, wherein: the forming die includes an upper die, a lower die and a blank holder, the upper die and the blank holder are connected to a press machine, the press machine is adapted to drive the upper die and the blank holder to move, the lower die is fixed on a workbench surface of the press machine, the blank holder is disposed above the lower die, and a blank to be drawn is placed between the lower die and the blank holder; the jacking unit is disposed inside the lower die and is adapted to move along a moving direction of the upper die to deform the blank to be drawn.

Alternatively, the lower die is fixed on the workbench surface of the press machine by a lower die fixing plate and a lower die support. The jacking unit includes a jacking ring, a guide portion, and the power unit which are connected to each other, a first end of the jacking unit is extended into a die cavity of the lower die, and a second end of the jacking unit is driven by the power unit to move on the lower die fixing plate.

Alternatively, the jacking unit includes the jacking ring and the guide portion which are connected to each other, the jacking ring is extended into the die cavity of the lower die and contact the blank to be drawn, the guide portion is connected to the power unit, and the power unit is adapted to power the guide portion and drive the guide portion and the jacking ring to move.

Alternatively, the guide portion includes a first guide mechanism connected to the jacking ring and two second guide mechanisms connected to the power unit, the first guide mechanism and the second guide mechanisms move in perpendicular directions, and the first guide mechanism is movably connected to the second guide mechanisms.

Alternatively, both of the second guide mechanisms are rotatably connected to the first guide mechanism, both of the second guide mechanisms are arranged on both sides of the first guide mechanism, respectively, and both of the second guide mechanisms move in opposite directions.

Alternatively, the first guide mechanism includes a longitudinal guide bar and a longitudinal pulley, the longitudinal guide bar is connected to the jacking ring, and the longitudinal pulley is used for connecting the longitudinal guide bar and the second guide mechanisms. Each of the second guide mechanisms includes a transverse guide bar and a transverse pulley, a first end of the transverse guide bar is connected to the longitudinal guide bar through the transverse pulley, and a second end of the transverse guide bar is connected to the power unit through the longitudinal pulley.

Alternatively, a contact end of the jacking ring with the blank to be drawn is provided with a rubber ring.

Alternatively, the power unit includes a hydraulic station and a hydraulic cylinder which are connected to each other, and the hydraulic cylinder is connected to the second guide mechanisms.

Alternatively, the apparatus for deep drawing of large-sized thin-wall curved surface parts with servo reverse bulging further includes a cooling unit, a first cooling cavity communicating with the cooling unit is provided in the lower die, and a second cooling cavity communicating with the cooling unit is provided in the blank holder; the first cooling cavity and/or the second cooling cavity are adapted to convey a cooling medium to the blank to be drawn.

Alternatively, a contact end of the lower die with the blank to be drawn is provided with a first cooling channel communicating with the first cooling cavity, and/or a contact end of the blank holder with the blank to be drawn is provided with a second cooling channel communicating with the second cooling cavity.

Alternatively, an inner end of the blank holder is provided with a third cooling channel communicating with the second cooling cavity, and the inner end of the blank holder is adjacent to the contact end of the blank holder with the blank to be drawn.

Alternatively, the cooling unit includes a cold source and a temperature control element, the cold source is communicating with the forming die through a pipeline, and the temperature control element is disposed on the pipeline.

The apparatus for deep drawing of large-sized thin-wall curved surface parts with servo reverse bulging of the present invention is more advantageous than the prior art in that the blank to be drawn in the suspended area experiences reverse bulging under the act of the jacking unit so that the stress of the blank to be drawn in the suspended area is changed from annular compressive stress to annular tensile stress, and wrinkling in the suspended area can thus be avoided. Compared with a liquid-filled drawing process, the jacking unit is used to replace hydraulic pressure to generate a counter-bulging effect, reducing the counterforce generated by liquid on the upper die, hence the drawing load is greatly reduced, and the tonnage of equipment is rendered, with a reduced thinning rate of the resultant part.

The invention also provides a method for deep drawing of large-sized thin-wall curved surface parts with servo reverse bulging based on the apparatus for deep drawing of large-sized thin-wall curved surface parts with servo reverse bulging described above, including the steps of:

step T1: fixing the lower die of the forming die on the workbench surface of the press machine, while placing the blank to be drawn on the lower die, and centering the blank to be drawn with the die cavity of the lower die;

step T2: lowering the blank holder to press the blank to be drawn, and forming a closed cavity on a flange side of the blank to be drawn;

step T3: applying a blank-holder force to the blank holder, and lowering the upper die to contact the blank to be drawn;

step T4: lifting the jacking unit upwards to contact the blank to be drawn, and enabling the blank to be drawn to deform reversely to form a convex hull;

step T5: continuously applying the blank-holder force to the blank holder, and lowering the upper die further with the jacking unit lowered together so that gradually the convex hull reduces in shape;

step T6: lowering the upper die even further with the jacking unit lowered accordingly until the blank to be drawn experiences the formation; and step T7: unloading the power unit of the jacking unit, returning the lower die and the blank holder, and taking out a resultant part.

The invention also provides a method for deep drawing of large-sized thin-wall curved surface parts with servo reverse bulging based on the apparatus for deep drawing of large-sized thin-wall curved surface parts with servo reverse bulging described above, the apparatus for deep drawing of large-sized thin-wall curved surface parts with servo reverse bulging further comprising the cooling unit, the first cooling cavity communicating with the cooling unit being provided in the lower die, and the second cooling cavity communicating with the cooling unit being provided in the blank holder, wherein the method includes the steps of:

step S1: fixing the lower die of the forming die on the workbench surface of the press machine while placing the blank to be drawn on the lower die, and centering the blank to be drawn with the die cavity of the lower die;

step S2: lowering the blank holder to press the blank to be drawn, and forming a closed cavity on a flange side of the blank to be drawn;

step S3: filling the lower die and the blank holder with the cooling medium to cool the lower die and the blank holder, and spraying the cooling medium on upper and the lower surfaces of the flange side of the blank to be drawn through the first cooling channel of the lower die and the second cooling channel of the blank holder to obtain a critical temperature for drawing;

step S4: applying a blank-holder force to the blank holder, and lowering the upper die to contact the blank to be drawn;

step S5: lifting the jacking unit upwards to contact the blank to be drawn, and enabling the blank to be drawn to deform reversely to form a convex hull;

step S6: spraying the cooling medium on an upper surface of the convex hull through a third channel of the blank holder so that a temperature of the convex hull is always below the critical temperature;

step S7: continuously applying the blank-holder force to the blank holder, and lowering the upper die further with the jacking unit lowered together so that gradually the convex hull reduces in shape;

step S8: lowering the upper die even further with the jacking unit lowered accordingly until the blank to be drawn experiences the formation; and step S9: stopping the supply of the cooling medium, unloading the power unit of the jacking unit, returning the lower die and the blank holder, and taking out a resultant part.

Alternatively, the cooling medium includes liquid oxygen, liquid argon, or liquid nitrogen.

How the method for deep drawing of large-sized thin-wall curved surface parts with servo reverse bulging of the present invention is more advantageous than the prior art is the same as how the apparatus for deep drawing of large-sized thin-wall curved surface parts with servo reverse bulging of the present invention is more advantageous than the prior art and will not be discussed again.

DESCRIPTION OF REFERENCE NUMBERS

Figure 1:
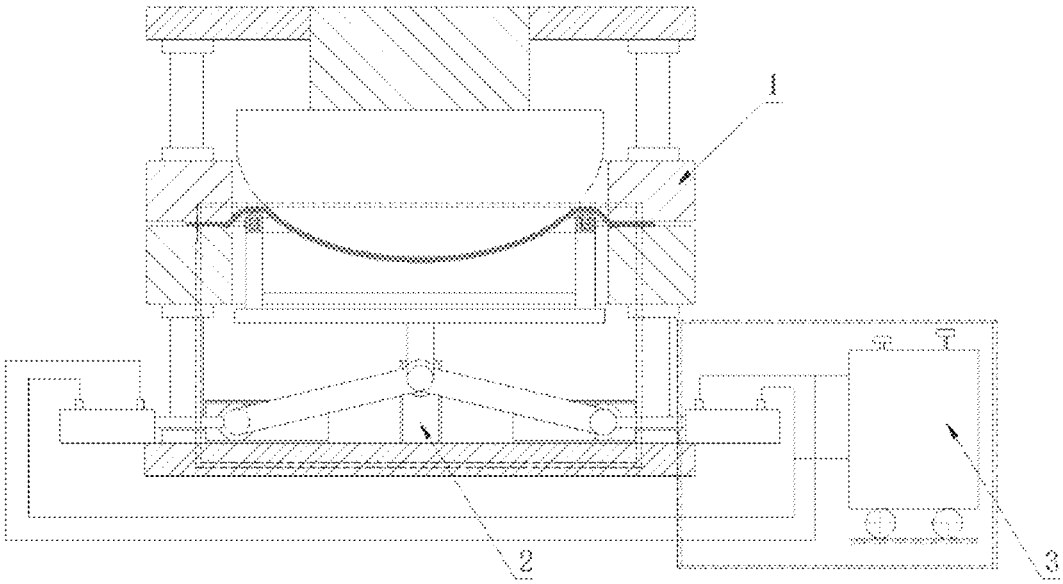
FIG. 1 is a first schematic view showing an overall structure of an apparatus for deep drawing of large-sized thin-wall curved surface parts with servo reverse bulging according to an embodiment of the present invention.

1—forming die; 11—upper die; 111—upper die fixing plate; 12—lower die; 121—first cooling cavity; 122—lower die fixing plate; 123—first cooling channel; 124—lower die support; 13—blank holder; 131—second cooling cavity; 132—second cooling channel; 133—blank holder fixing plate; 134—third cooling channel; 135—blank holder support; 14—insulation cover;

2—jacking unit; 21—jacking ring; 211—rubber ring; 22—support frame; 23—transverse guide bar; 24—longitudinal guide bar; 25—transverse pulley; 26—longitudinal pulley;

3—power unit; 31—hydraulic cylinder; 32—synchronization valve; 33—hydraulic station;

4—cold source; 41—Dewar flask; 42—pipeline;

5—temperature control element; 51—flow valve; 52—check valve; 53—flow meter; 54—temperature detector.

DETAILED DESCRIPTION OF THE INVENTION

In the description of the present invention, it should be understood that a movement forward in direction "X" in the drawings represents one to the right, a movement backward in direction "X" represents one to the left, a movement forward in direction "Y" in the drawings represents one to the above, a movement backward in direction "Y" represents one to the below, the orientation or positional relationship indicated by the terms "X" and "Y" is based on the orientation or positional relationship shown in the drawings and serves only for the convenience of describing the present invention and simplifying the illustration, rather than indicating or implying that device or element referred to must have a specific orientation or be constructed and operated in a specific orientation. Therefore, such a description cannot be understood as a limitation of the present invention.

The terms "first", "second", "third" and "fourth" are only used for descriptive purposes and cannot be understood as indicating or implying relative importance or implicitly indicating the number of indicated technical features. Therefore, the features defined with "first", "second", "third" and "fourth" may explicitly or implicitly include at least one of the features.

The description using the phrase "some specific embodiments" means that specific features, structures, materials, or characteristics described in conjunction with the embodiments or examples are included in at least one embodiment or example of the present invention. In this description, illustrative use of the above-mentioned phrase does not necessarily refer to the same implementation or example. Moreover, the described specific features, structures, materials, or characteristics can be combined in any one or more embodiments or examples as appropriate.

It is to be noted that the large-sized thin-wall curved surface part in the embodiment can be a thin-wall enclosure of a large dimension, which is an indispensable important part in the petrochemical industry, food pharmacy, aerospace, and other equipment as a cap on a pressure container, for example, as a bottom of a fuel tank of a launch vehicle, typically greater than 2 m in diameter and 2 mm to 4 mm in thickness. The thin-wall enclosure of a large dimension in the embodiment can be an aluminum and aluminum alloy enclosure or an enclosure with a tailor-welded structure made of aluminum and aluminum alloy.

Figure 2:
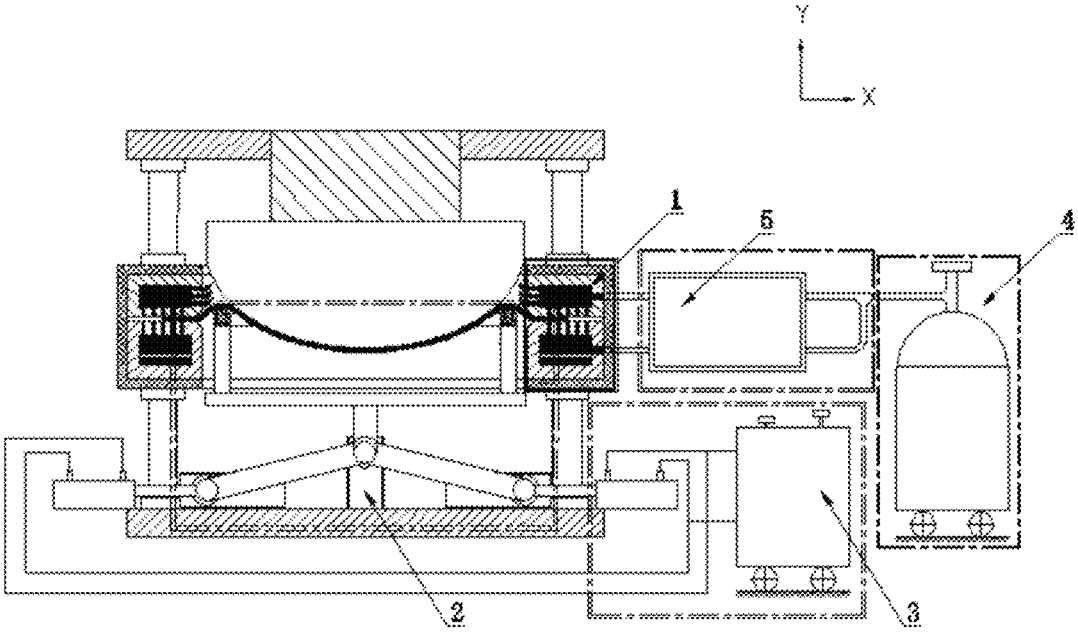
FIG. 2 is a second schematic view showing an overall structure of the apparatus for deep drawing of large-sized thin-wall curved surface parts with servo reverse bulging according to an embodiment of the present invention.
Figure 3:
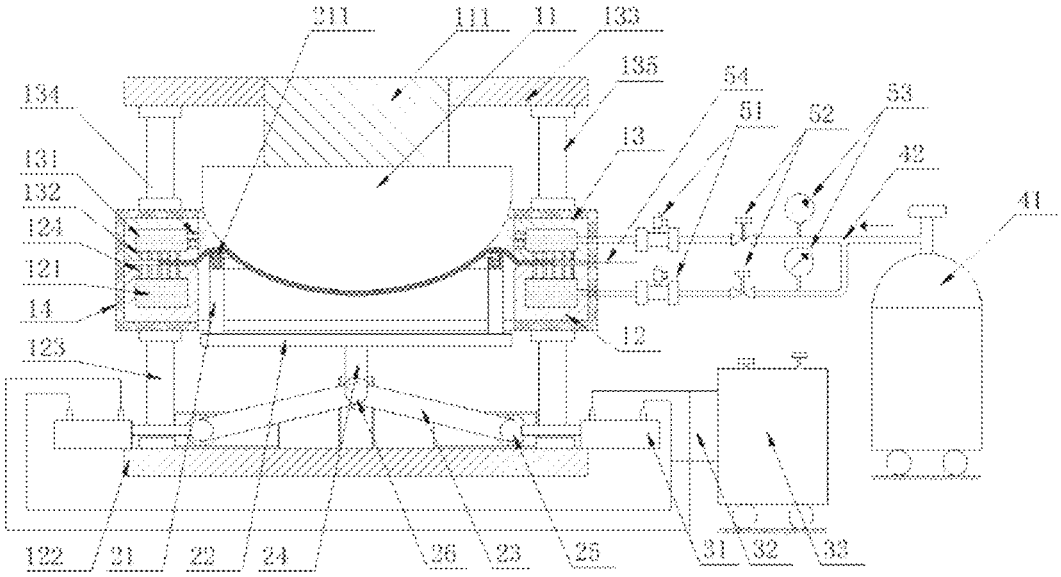
FIG. 3 is a schematic view of structural details of the apparatus for deep drawing of large-sized thin-wall curved surface parts with servo reverse bulging according to an embodiment of the present invention.

As shown in FIGS. 1 to 3, an embodiment of the invention provides an apparatus for deep drawing of large-sized thin-wall curved surface parts with servo reverse bulging, including:

a forming die 1, a jacking unit 2, and a power unit 3; wherein:

the forming die 1 includes an upper die 11, a lower die 12, and a blank holder 13, the upper die 11 and the blank holder 13 are connected to a press machine, the press machine is adapted to drive the upper die 11 and the blank holder 13 to move, the lower die 12 is fixed on a workbench surface of the press machine, the blank holder 13 is disposed above the lower die 12, and a blank to be drawn is placed between the lower die 12 and the blank holder 13. The jacking unit 2 is disposed inside the lower die 12, an upper end of the jacking unit 2 is extended into a die cavity of the lower die 12, a lower end of the jacking unit 2 is adapted to move on a lower die fixing plate 122 when driven by the power unit 3, and the jacking unit 2 is adapted to move in a moving direction of the upper die 11 to deform the blank to be drawn.

In this embodiment, the blank to be drawn in the suspended area experiences reverse bulging under the act of the jacking unit 2 so that the stress of the blank to be drawn in the suspended area is changed from annular compressive stress to annular tensile stress, and wrinkling in the suspended area can thus be avoided. Compared with a liquid-filled drawing process, the jacking unit 2 is used to replace hydraulic pressure to generate a counter-bulging effect, reducing the counterforce generated by liquid on the upper die 11. Hence, the drawing load is greatly reduced, and the tonnage of equipment is rendered, with a reduced thinning rate of the resultant part.

In some preferred embodiments, the lower die 12 is fixedly mounted on the workbench surface of the press machine through the lower die fixing plate 122 and a lower die support 124, the upper die 11 and the blank holder 13 are connected to a drawing cylinder and a blank holder cylinder of the press machine, respectively, through an upper die fixing plate 111, a blank holder support 135, and a blank holder fixing plate 133, and drawing and blank-holder loads are applied to the upper die 11 and the blank holder 13 to drive the upper die 11 and the blank holder 13 to move. It is noted that, in this embodiment, the press machine being adapted to move the upper die 11 and the blank holder 13 includes a case of the press machine being adapted to move the upper die 11 and the blank holder 13 in direction Y.

In some preferred embodiments, the jacking unit 2 includes a jacking ring 21 and a guide portion which are connected to each other, the jacking ring 21 is extended into the die cavity of the lower die 12 to contact the blank to be drawn, the guide portion is connected to the power unit 3, and the power unit 3 is adapted to power the guide portion to move the guide portion and the jacking ring 21. Therefore, the jacking unit 2 can convert the movement in a horizontal direction into the movement in a vertical direction, thereby lowering the standards of space required for vertical loading inside the die. Compared with the liquid-filled drawing process, the jacking ring 21 is used to replace hydraulic pressure to generate a reverse bulging effect so that the counterforce generated by liquid on the upper die 11 is reduced, the load in the drawing process is greatly reduced, and the tonnage of equipment is small.

In some specific embodiments, the jacking ring 21 is connected to the guide portion through a support frame 22, and the jacking ring 21 includes jacking bars vertically arranged at both ends of the support frame 22. In some specific examples, how the support frame 22 and the jacking bars are connected is not limited. In some preferred embodiments, the support frame 22 is integrally connected to the jacking bars, convenient and firm.

In some preferred embodiments, a through-hole matching a contour of the jacking bar is provided inside the lower die 12, the jacking bar being adapted to move up and down within the die cavity of the lower die 12 through the through-hole.

In some preferred embodiments, the guide portion includes a first guide mechanism connected to the jacking ring 21 and two second guide mechanisms connected to the power unit 3, the first guide mechanism and the second guide mechanisms move in perpendicular directions and are movably connected. In some specific embodiments, the first guide mechanism is movable in a vertical direction when driven by the power unit 3 and the second guide mechanisms are movable in a horizontal direction when driven by the power unit 3.

In some embodiments, the first guide mechanism is connected to the support frame 22. How the first guide mechanism is connected to the support frame 22 is not limited in this embodiment. In some preferred embodiments, the first guide mechanism is integrally connected to the support frame 22, convenient and firm.

In some preferred embodiments, both of the second guide mechanisms are rotatably connected to the first guide mechanism, both of the second guide mechanisms are arranged on both sides of the first guide mechanism, respectively, and both of the second guide mechanisms move in opposite directions.

In some preferred embodiments, the first guide mechanism includes a longitudinal guide bar 24 connected to the jacking ring 21 and a longitudinal pulley 26 for connecting the longitudinal guide bar 24 and the second guide mechanisms; each of the second guide mechanisms includes a transverse guide bar 23 and a transverse pulley 25, a first end of the transverse guide bar 23 is connected to the longitudinal guide bar 24 through the transverse pulley 25, and a second end of the transverse guide bar 23 is connected to the power unit 3 through the longitudinal pulley 26, the friction being reduced with the pulley, and thus the thrust force of the power unit 3 being reduced.

In some preferred embodiments, the power unit 3 includes a hydraulic station 33 and a hydraulic cylinder 31 which are connected to each other, and the hydraulic cylinder 31 is connected to the second guide mechanisms to drive the second guide mechanisms to move in the horizontal direction and then drive the first guide mechanism to move in the vertical direction and controls a jacking height so that the real-time adjustment and control of a shape of the reverse bulging as the drawing stroke changes are realized. In some specific embodiments, the power unit 3 further includes a synchronization valve 32, each second guide mechanism is connected to one hydraulic cylinder 31, a plurality of hydraulic cylinders 31 are connected to the hydraulic station 33, and the synchronization valve 32 controls both of the second guide mechanisms to move horizontally in synchronization to enable longitudinal movement of the first guide structure.

In some specific embodiments, when the power unit 3 pushes the transverse pulleys 25 and the transverse guide bars 23 of both of the second guide mechanisms to move towards each other in the horizontal direction, the longitudinal pulley 26 and the longitudinal guide bar 24 of the jacking unit 2 are then driven to move longitudinally upwards, and the jacking ring 21 of the jacking unit 2 is lifted upwards. When the power unit 3 pulls the transverse pulleys 25 and the transverse guide bars 23 of both of the second guide mechanisms to move oppositely in the horizontal direction, the longitudinal pulley 26 and the longitudinal guide bar 24 of the jacking unit 2 are then driven to move longitudinally downwards, and the jacking ring 21 of the jacking unit 2 is lowered. By connecting the power unit 3 with the jacking unit 2, the movement in the horizontal direction is converted into the movement in the vertical direction, thereby lowering the standards for the space required for vertical loading inside the die.

In some preferred embodiments, a contact end of the jacking ring 21 with the blank to be drawn is provided with a rubber ring 211, which avoids direct contact of the jacking ring 21 with the blank to be drawn and damage caused thereto.

In some preferred embodiments, the rubber ring 211 is made of a polytetrafluoroethylene material resistant to a low temperature and having a small friction coefficient, capable of reducing friction between the blank and the jacking ring 21 during reverse bulging of the jacking ring 21.

In some preferred embodiments, the apparatus for deep drawing of large-sized thin-wall curved surface parts with servo reverse bulging further includes a cooling unit, a first cooling cavity 121 communicating with the cooling unit is provided in the lower die 12, and a second cooling cavity 131 communicating with the cooling unit is provided in the blank holder 13. The first cooling cavity 121 and/or the second cooling cavity 131 are adapted to convey a cooling medium to the blank to be drawn.

In some preferred embodiments, the blank holder 13 and the lower die 12 are wrapped with heat insulation sleeves 14 outside to insulate from the ambient temperature and prevent influences on the cooling temperatures of the blank holder 13 and the lower die 12.

The shape of the first cooling cavity 121 and the second cooling cavity 131 is not limited in this embodiment and can be any geometric shape. In some preferred embodiments, the cross-sections of the first cooling cavity 121 and the second cooling cavity 131 are rectangular, simple in structure and easy to process.

As shown in FIG. 3, in some preferred embodiments, a contact end of the lower die 12 with the blank to be drawn is provided with a first cooling channel 123 communicating with the first cooling cavity 121, and/or a contact end of the blank holder 13 with the blank to be drawn is provided with a second cooling channel 132 communicating with the second cooling cavity 131. Note that in this embodiment, the contact end of the lower die 12 with the blank to be drawn is an upper surface of the lower die 12, and the contact end of the blank holder 13 with the blank to be drawn is a lower surface of the blank holder 13.

In some preferred embodiments, an inner end of the blank holder 13 is provided with a third cooling channel 134 communicating with the second cooling cavity 131, and the inner end of the blank holder 13 is provided adjacent to the contact end of the blank holder 13 with the blank to be drawn. Note that the inner end of the blank holder 13 in this embodiment is a right side of the blank holder 13 in the drawings.

The structure of the first cooling channel 123, the second cooling channel 132, and the third cooling channel 134 is not limited in this embodiment as long as the cooling medium can be sprayed out through the first cooling channel 123, the second cooling channel 132, and the third cooling channel 134. In some preferred embodiments, the first cooling channel 123 is composed of a plurality of circular deep holes communicating with the first cooling cavity 121 and annularly distributed at an upper end of the lower die 12, and the second cooling channel 132 and the third cooling channel 134 are both composed of a plurality of circular deep holes communicating with the second cooling cavity 131 and annularly distributed at a lower end and a right end of the blank holder 13, respectively, so that the cooling medium can be uniformly sprayed on the upper and lower surfaces of the blank to be drawn to obtain a lower critical temperature for drawing, or the cooling medium can be uniformly sprayed on a surface of a convex hull of the blank to be drawn, hence the temperature of the blank to be drawn at the position of the convex hull is always below the critical temperature, and the strength and the plasticity of the local blank are both increased, avoiding local cracking caused by reverse bulging at the position of the convex hull.

In some preferred embodiments, a die cavity of the jacking ring 21 is provided with a third cooling cavity communicating with the cooling unit, and a first end of the jacking ring 21 in contact with the blank to be drawn is provided with a fourth cooling channel communicating with the third cooling cavity. In this embodiment, the structure of the fourth cooling channel is not limited, as long as the cooling medium can be sprayed out through the fourth cooling channel. In some preferred embodiments, the fourth cooling channel is composed of a plurality of circular deep holes communicating with the third cooling cavity and annularly distributed at an upper end of the jacking ring 21 so that the cooling medium can be uniformly sprayed on the lower surface of the convex hull of the blank to be drawn, hence the temperature of the blank to be drawn at the position of the convex hull is always below the critical temperature, and the strength and the plasticity of the local blank are both increased, avoiding local cracking caused by reverse bulging at the position of the convex hull.

In some preferred embodiments, the cooling unit includes a cold source 4 communicating with the forming die 1 through a pipeline 42 and a temperature control element 5 disposed on the pipeline 42. In some preferred embodiments, the cold source 4 is a Dewar flask 41 containing the cooling medium.

In some preferred embodiments, the cooling unit further includes a temperature detector 54 connected to the temperature control element 5, and the temperature detector 54 can be connected to the lower die 12 or the blank holder 13 and is used for detecting the temperature in the lower die 12 or the blank holder 13 and controlling a flow rate of the cooling medium with the temperature control element 5 according to a detection result. Hence, the temperature control is accurate and the formation is facilitated. In some specific embodiments, the temperature control element 5 includes a flow valve 51, a check valve 52 and a flow meter 53, which is accurate in control and convenient to operate.

The apparatus for deep drawing of large-sized thin-wall curved surface parts with servo reverse bulging of the present invention is more advantageous than the prior art in that it can inhibit the defects of wrinkling and cracking in the process of drawing effectively, render a small forming load and a simple structure, and facilitate the manufacturing of a resultant part, specifically:

The blank to be drawn in the suspended area bulges reversely because of the jacking unit 2, the stress experienced by the blank to be drawn in the suspended area is changed from annular compressive stress to annular tensile stress, which can avoid the defect of wrinkling in the suspended area.

The lower die 12 and the blank holder 13 are provided with the first cooling channel 123 and the second cooling channel 132, respectively, to obtain a lower forming temperature which is beneficial for forming and render better forming effects.

The blank holder 13 is provided with the third cooling channel 134, through which the cooling medium is sprayed to cool the reverse bulging area of the blank to be drawn locally, hence the blank to be drawn in the reverse bulging area is locally reinforced and plasticized, and protected from cracking.

Compared with the liquid-filled drawing process, the jacking unit 2 is used to replace hydraulic pressure to generate a reverse bulging effect so that the counterforce generated by liquid on the upper die 11 is reduced, the load in the drawing process is greatly reduced, the tonnage of equipment is small, and the reduction rate of the resultant part is low.

Compared with a method where multi-stage annular sleeves and a plurality of oil cylinders are provided inside the die to drive, a power unit 3 system external to the die is used by the present invention to replace the plurality of oil cylinders inside the die, the installation of an oil cylinder of a large tonnage is not limited by the space inside the die, hence the problem of cooperative control of the plurality of oil cylinders is addressed, and the manufacturing and the implementation are easier.

An embodiment of the invention also provides a method for forming the large-sized thin-wall curved surface part at an ultra-low temperature based on the apparatus for deep drawing of large-sized thin-wall curved surface parts with servo reverse bulging described above, including the steps of:

step T1: fixing the lower die 12 of the forming die 1 on the workbench surface of the press machine while placing the blank to be drawn on the lower die 12, and centering the blank to be drawn with the die cavity of the lower die 12;

step T2: lowering the blank holder 13 to press the blank to be drawn, and forming a closed cavity on a flange side of the blank to be drawn;

step T3: applying a blank-holder force to the blank holder 13 after reaching a temperature for drawing the blank to be drawn, and lowering the upper die 11 to contact the blank to be drawn;

step T4: lifting the jacking unit 2 upwards to contact the blank to be drawn, and enabling the blank to be drawn to deform reversely to form a convex hull; where specifically, the power unit 3 pushes the transverse pulley 25 and the transverse guide bar 23 of the jacking unit 2 to move in a forward direction transversely, and then drives the longitudinal pulley 26 and the longitudinal guide bar 24 of the jacking unit 2 to move in a forward direction longitudinally; the jacking ring 21 of the jacking unit 2 is lifted so that the blank to be drawn contact the jacking ring 21 and deforms reversely under the action of the jacking ring 21 to form the convex hull; it is noted that in the embodiment, the movement in the forward direction transversely refers to both of the second guide mechanisms moving towards each other in direction X in the drawings, and the movement in the forward direction longitudinally refers to both of the second guide mechanisms moving towards each other in direction Y in the drawings;

step T5: continuously applying the blank-holder force to the blank holder 13, and lowering the upper die 11 further with the jacking unit 2 lowered along with the upper die 11 at the same pace and the shape of the convex hull being gradually reduced, where specifically, the blank-holder force is further applied to the blank holder 13, the upper die 11 continues to descend, and the power unit 3 pulls the transverse pulley 25 and the transverse guide bar 23 of the jacking unit 2 to move in a backward direction transversely and then drives the longitudinal pulley 26 and the longitudinal guide bar 24 of the jacking unit 2 to move in a backward direction longitudinally so that the jacking ring 21 is lowered along with the upper die 11, and the shape of the convex hull is gradually reduced; it is noted that in the embodiment, the movement in the backward direction transversely refers to both of the second guide mechanisms moving oppositely and backward in direction X as shown in the drawings, and the movement in the backward direction longitudinally refers to both of the second guide mechanisms moving backward in direction Y as shown in the drawings;

step T6: lowering the upper die 11 even further with the jacking ring 21 lowered accordingly under the control of the power unit 3 until the blank to be drawn experiences the formation; and step T7: stopping the supply of the cooling medium to the forming die 1, unloading the power unit 3, returning the lower die 12 and the blank holder 13, and taking out a resultant part.

In some preferred embodiments, in steps T5 and T6, in the process of lowering the jacking unit 2, the displacement velocity of the upper die 11 is a function of the displacement velocity of the jacking ring 21 of the jacking unit 2 as follows:

$$\frac{v'}{v} = \frac{R^2}{2H} \cdot \frac{v \cdot \sqrt{2hH - h^2} - \frac{vH - vh}{-\sqrt{2hH - h^2}}(h - H)}{2hH - h^2} - \frac{R^2}{2H^2}v + \frac{R}{2H}\left[-\frac{1}{2}(2hH - h^2)^{-\frac{3}{2}}(2vH - 2vh)\right],$$

where H is a depth of the curved surface part, R is a radius of the curved surface part, h is a stroke of the upper die 11, v is a displacement velocity of the upper die 11, and v' is a displacement velocity of the jacking ring 21.

Therefore, the shape of the convex hull in this embodiment can be controlled by the displacement velocities of the jacking ring 2 and the upper die 11 so that the deformation of the convex hull can be controlled.

Figure 8:
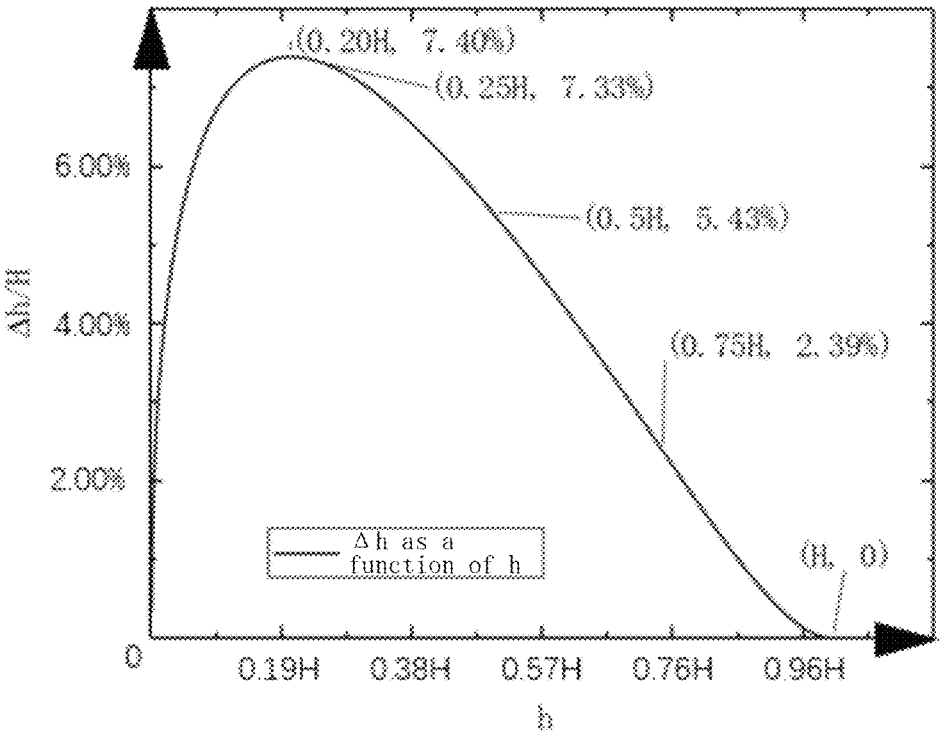
FIG. 8 is a graph showing a displacement of a jacking ring as a function of a displacement of an upper die according to an embodiment of the present invention.

In some preferred embodiments, in the process of forming the large-sized thin-wall curved surface part at an ultra-low temperature, the shape of the convex bulge formed by the blank to be drawn in the process of drawing can be controlled by adjusting the displacement of the jacking ring 21 and the drawing displacement of the upper die 11. As shown in FIG. 8, H is the depth of the curved surface part, h is the stroke of the upper die 11, and Ah is a stroke of the jacking ring 21.

Figure 9:
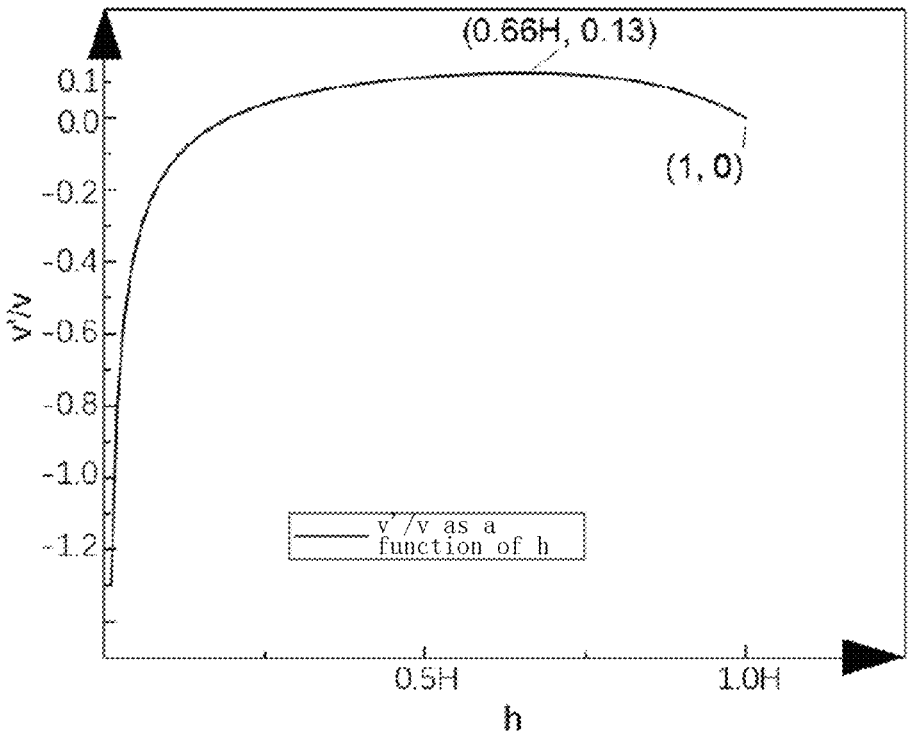
FIG. 9 is a graph showing a displacement velocity of the jacking ring as a function of the displacement of the upper die according to an embodiment of the present invention.

In other preferred embodiments, in the process of forming the large-sized thin-wall curved surface part at an ultra-low temperature, the shape of the convex bulge formed by the blank to be drawn in the process of drawing can be controlled by adjusting the displacement velocity of the jacking ring 21 and the drawing displacement of the upper die 11. As shown in FIG. 9, H is the depth of the curved surface part, h is the stroke of the upper die 11, v is the displacement velocity of the upper die 11, Δh is the stroke of the jacking ring 21, v' is the displacement velocity of the jacking ring 21, and the downward displacement velocity is positive, and the upward displacement velocity is negative.

It should be noted that in the above embodiment, the stroke h of the upper die 11 refers to a distance from a position at which the upper die 11 contacts the blank to be drawn to any point in the process of lowering the upper die 11 in direction Y, and the stroke Ah of the jacking ring 21 refers to a distance from a position of the jacking ring 21 at which the upper die 11 contacts the blank to be drawn to any point in the process of lowering the jacking ring 21 in direction Y.

Therefore, the method for deep drawing of large-sized thin-wall curved surface parts with servo reverse bulging according to the embodiment of the present invention can inhibit the defects of wrinkling and cracking in the process of drawing an aluminum alloy thin-wall enclosure of a large dimension effectively, free of the limitation on the space available, with a small forming load, featuring a simple structure, and convenient to implement.

Figure 7:
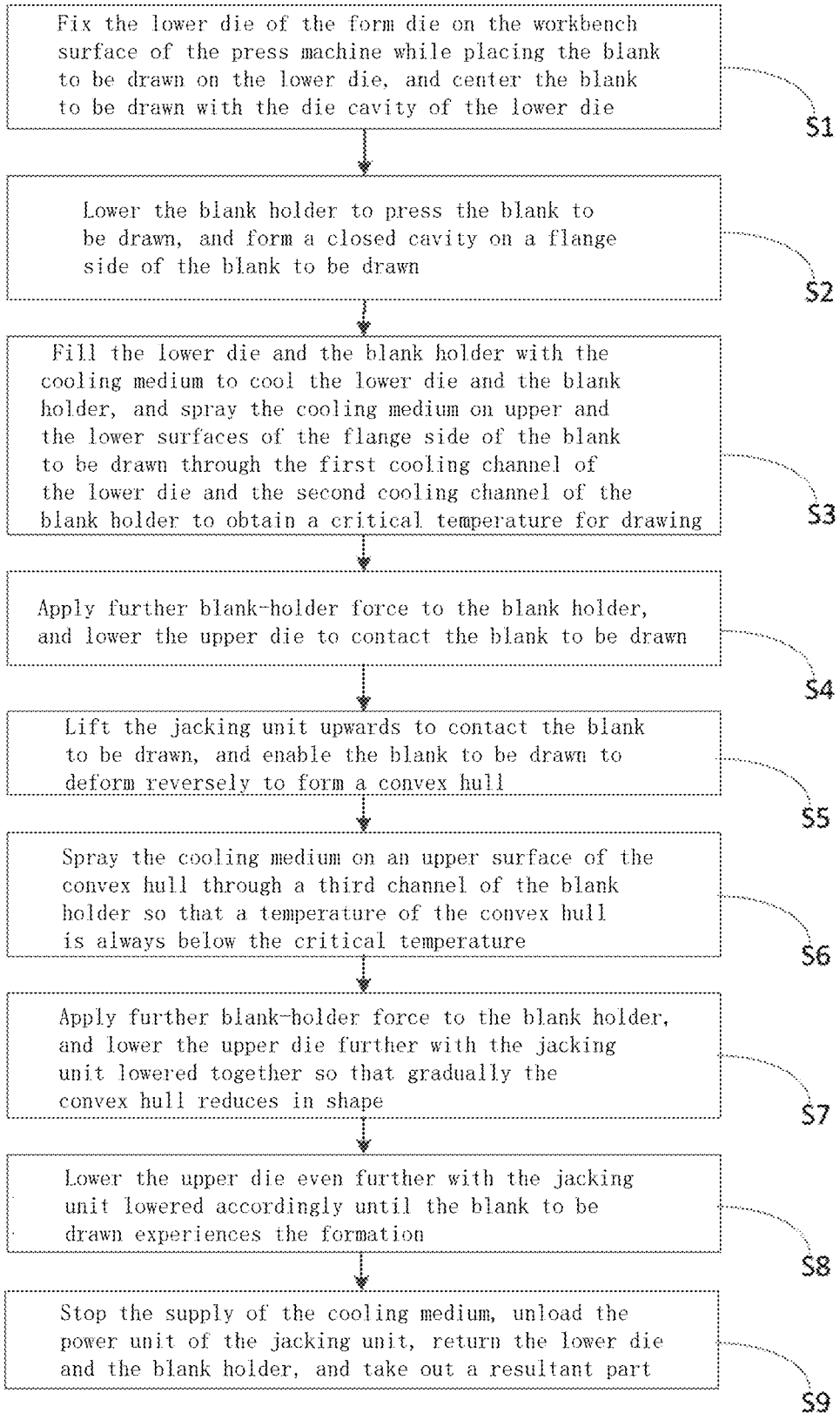
FIG. 7 is a flowchart of a method for forming an aluminum alloy deep cavity member at an ultra-low temperature according to an embodiment of the present invention.

As shown in FIG. 7, an embodiment of the invention also provides a method for forming the large-sized thin-wall curved surface part at an ultra-low temperature based on the apparatus for deep drawing of large-sized thin-wall curved surface parts with servo reverse bulging described above, including the steps of:

step S1: fixing the lower die 12 of the forming die 1 on the workbench surface of the press machine while placing the blank to be drawn on the lower die 12, and centering the blank to be drawn with the die cavity of the lower die 12;

step S2: lowering the blank holder 13 to press the blank to be drawn, and forming a closed cavity on a flange side of the blank to be drawn;

step S3: filling the lower die 12 and the blank holder 13 with the cooling medium to cool the lower die 12 and the blank holder 13, thereby obtaining a lower temperature of the die, and spraying the cooling medium on upper and the lower surfaces of the flange side of the blank to be drawn through the first cooling channel of the lower die 12 and the second cooling channel of the blank holder 13 to obtain a critical temperature for drawing;

step S4: applying a blank-holder force to the blank holder 13, and lowering the upper die 11 to contact the blank to be drawn;

step S5: lifting the jacking unit 2 upwards to contact the blank to be drawn, and enabling the blank to be drawn to deform reversely to form a convex hull; where specifically, the power unit 3 of the jacking unit 2 pushes the transverse pulley 25 and the transverse guide bar 23 of the jacking unit 2 to move in a forward direction transversely, and then drives the longitudinal pulley 26 and the longitudinal guide bar 24 of the jacking unit 2 to move in a forward direction longitudinally; the jacking ring 21 of the jacking unit 2 is lifted so that the blank to be drawn contact the jacking ring 21 and deforms reversely under the action of the jacking ring 21 to form the convex hull; it is noted that in the embodiment, the movement in the forward direction transversely refers to both of the second guide mechanisms moving towards each other in direction X in the drawings, and the movement in the forward direction longitudinally refers to both of the second guide mechanisms moving towards each other in direction Y in the drawings;

step S6: spraying the cooling medium on an upper surface of the convex hull through the third channel of the blank holder 13 so that the temperature at the position of the convex hull is always below the critical temperature, the blank is reinforced and plasticized locally, and local cracking caused by reverse bulging at the position is avoided;

step S7: continuously applying the blank-holder force to the blank holder 13, and lowering the upper die 11 further with the jacking unit 2 lowered along with the upper die 11 at the same pace and the shape of the convex hull being gradually reduced, where specifically, the blank-holder force is further applied to the blank holder 13, the upper die 11 continues to descend, and the power unit 3 of the jacking unit 2 pulls the transverse pulley 25 and the transverse guide bar 23 of the jacking unit 2 to move in a backward direction transversely and then drives the longitudinal pulley 26 and the longitudinal guide bar 24 of the jacking unit 2 to move in a backward direction longitudinally so that the jacking ring 21 is lowered along with the upper die 11, and the shape of the convex hull is gradually reduced; it is noted that in the embodiment, the movement in the backward direction transversely refers to both of the second guide mechanisms moving oppositely and backward in direction X as shown in the drawings, and the movement in the backward direction longitudinally refers to both of the second guide mechanisms moving backward in direction Y as shown in the drawings;

step S8: lowering the upper die 11 even further with the jacking ring 21 lowered accordingly under the control of the power unit 3 of the jacking unit 2 until the blank to be drawn experiences the formation; and step S9: closing the cooling unit, stopping the supply of the cooling medium to the forming die 1, unloading the power unit 3, returning the lower die 12 and the blank holder 13, and taking out a resultant part.

In some preferred embodiments, the cooling medium includes liquid oxygen, liquid argon, or liquid nitrogen. In some specific embodiments, the cooling medium can be any one of liquid oxygen at a temperature of −183° C., liquid argon at a temperature of −186° C., or liquid nitrogen at a temperature of −196° C., capable of rapidly reaching the cooling temperature, available from various sources and cheap.

Figure 10:
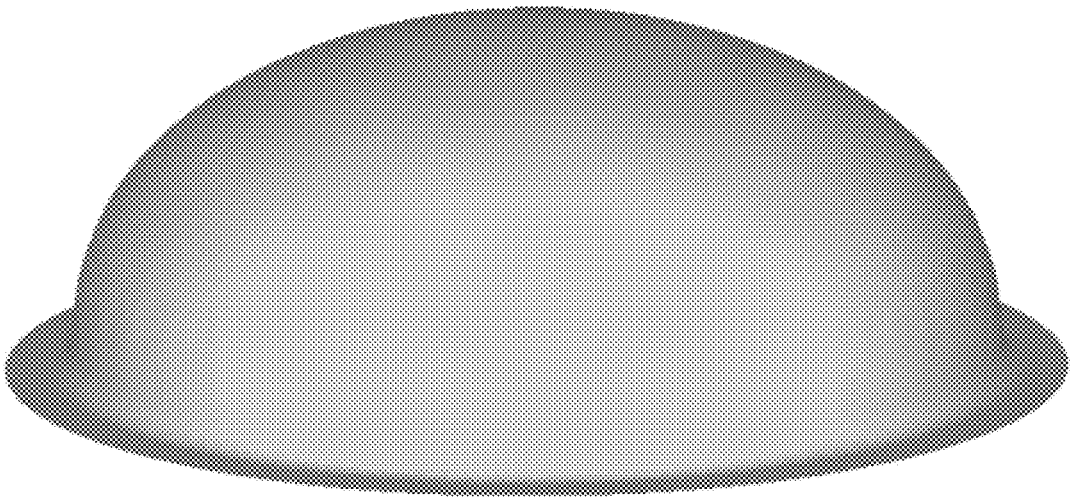
FIG. 10 is a schematic view showing a structure of a large-sized thin-wall curved surface part manufactured according to an embodiment of the present invention.

As shown in FIG. 10, according to the method for deep drawing of large-sized thin-wall curved surface parts with servo reverse bulging, on one hand, the power unit 3 external to the forming die 1 drives the jacking ring 21 in the die to vertically move, the displacement or the velocity of the jacking ring 21 and the upper die 11 is adjusted and controlled to adjust the shape of the reverse bulging convex hull formed on the blank to be drawn in the process of drawing, and wrinkling is avoided. On the other hand, by providing a third cooling channel 134 in the blank holder 13, the low-temperature cooling medium is sprayed to the reverse bulging convex hull to locally cool the blank to be drawn, hence the blank to be drawn is locally reinforced and plasticized in the reverse bulging area, local cracking is avoided, and a large-sized thin-wall curved surface part is obtained.

How the method for deep drawing of large-sized thin-wall curved surface parts with servo reverse bulging of the present invention is more advantageous than the prior art is the same as how the apparatus for deep drawing of large-sized thin-wall curved surface parts with servo reverse bulging of the present invention is more advantageous than the prior art and will not be discussed again.

Example 1

Figure 4:
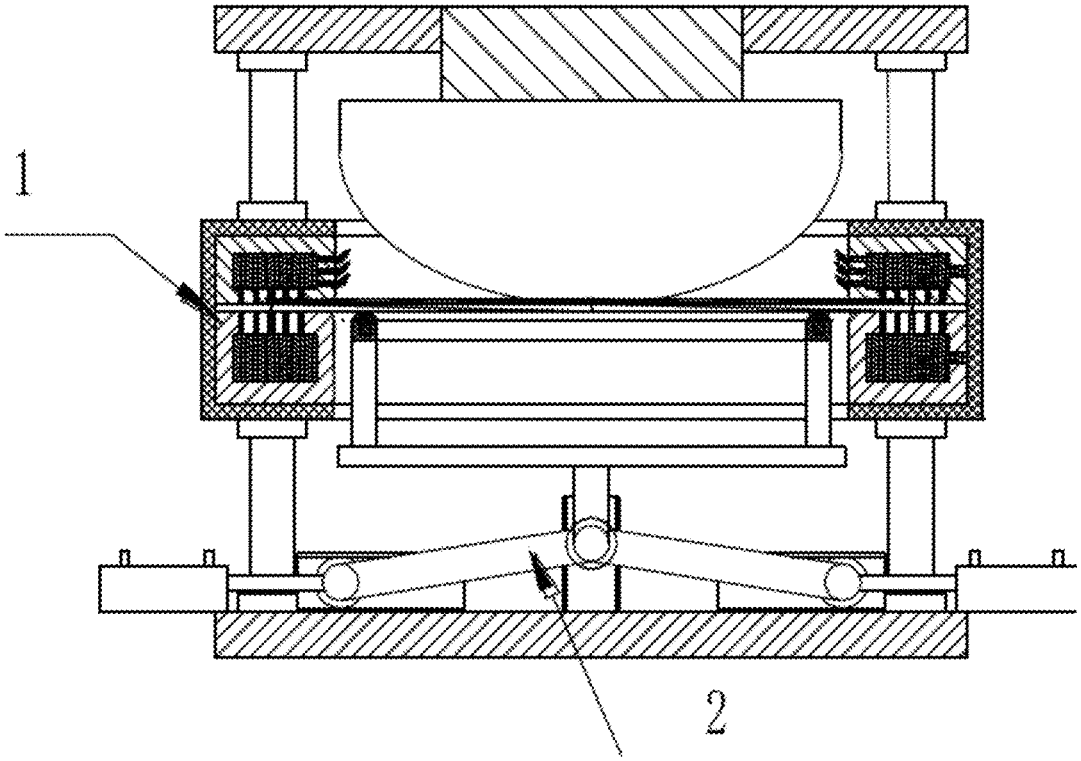
FIG. 4 is a first schematic view showing a working state of a partial structure of the apparatus for deep drawing of large-sized thin-wall curved surface parts with servo reverse bulging according to an embodiment of the present invention.
Figure 5:
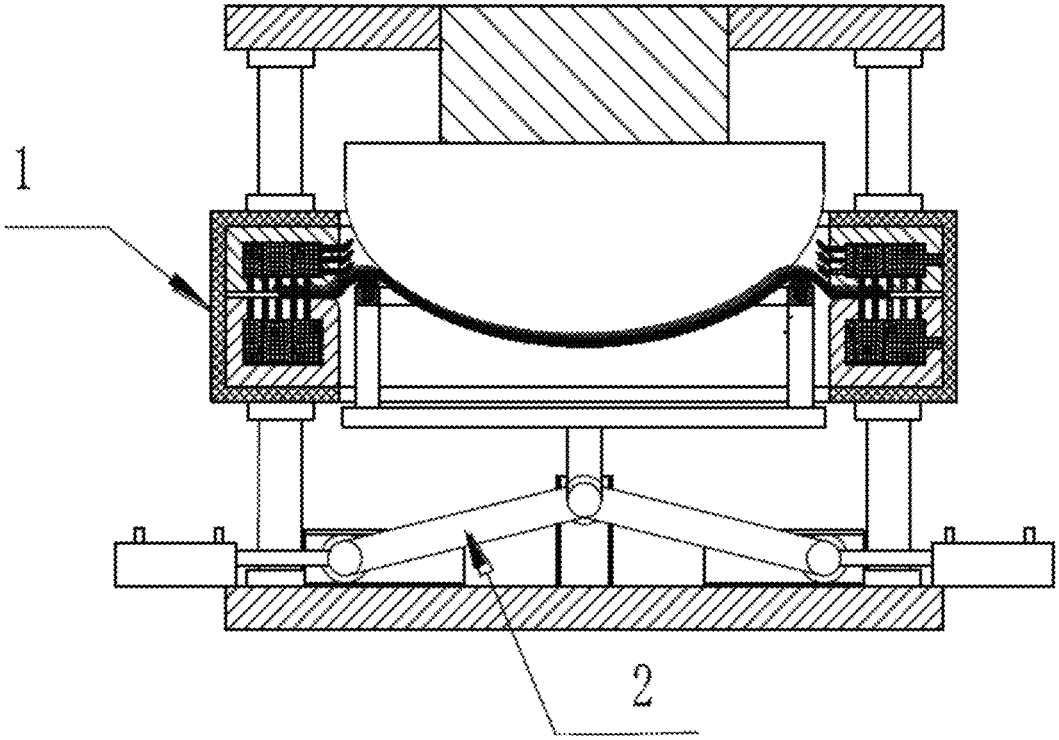
FIG. 5 is a second schematic view showing a working state of a partial structure of the apparatus for deep drawing of large-sized thin-wall curved surface parts with servo reverse bulging according to an embodiment of the present invention.
Figure 6:
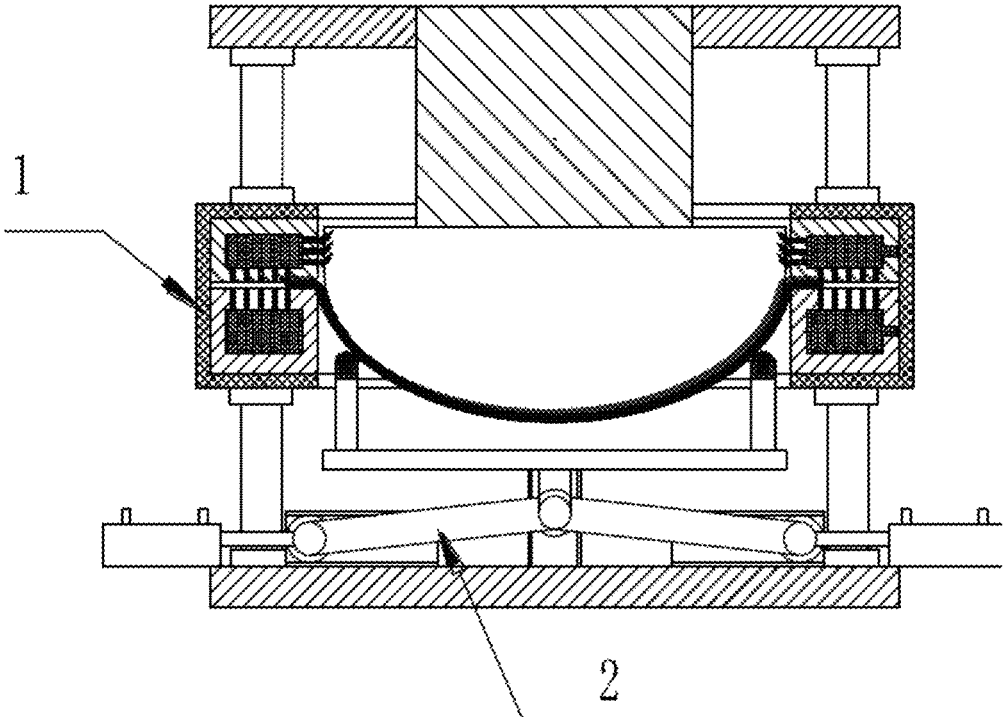
FIG. 6 is a third schematic diagram showing a working state of a partial structure of the apparatus for deep drawing of large-sized thin-wall curved surface parts with servo reverse bulging according to an embodiment of the present invention.

As shown in FIGS. 4 to 6, the embodiment provides a method for deep drawing of a thin-wall enclosure of a large dimension and with an opening diameter of 2250 mm with servo reverse bulging; herein, the blank to be drawn is a solution-anneal AA 2219 aluminum alloy, and the implementation process includes the steps as follows.

In step T1, the lower die 12 is fixed on the workbench surface of the press machine, the blank to be drawn is placed on the lower die 12, and the blank to be drawn is centered with the die cavity of the lower die 12.

In step T2, the blank holder 13 descends and presses the blank to be drawn, and a closed cavity is formed on the flange side of the blank to be drawn.

In step T3, a blank-holder force is applied to the blank holder 13, and the upper die 11 is lowered to contact the blank to be drawn.

In step T4, the power unit 3 pushes two transverse pulleys 25 and two transverse guide bars 23 to move towards each other in direction X as shown in the drawings and then drives the longitudinal pulley 26 and the longitudinal guide bar 24 to move forwards in direction Y as shown in the drawings, and the jacking ring 21 is lifted so that the blank to be drawn contacts the jacking ring 21 and reversely deforms under the action of the jacking ring 21 to form the convex hull.

In step T5, the blank-holder force is continuously applied to the blank holder 13, the upper die 11 is further lowered, the power unit 3 pulls two transverse pulleys 25 and two transverse guide bars 23 to move oppositely in direction X as shown in the drawings and then drives the longitudinal pulley 26 and the longitudinal guide bar 24 to move backwards in direction Y as shown in the drawings so that the jacking ring 21 is lowered along with the upper die 11, and the convex hull is gradually reduced in shape.

In step T6, the upper die 11 is lowered further, and the jacking ring 21 is lowered accordingly under the control of the power unit 3 until the blank to be drawn experiences the formation.

In step T7, the power unit 3 is unloaded, the lower die 12 and the blank holder 13 returns, and the resultant part is taken out.

Example 2

Figure 11:
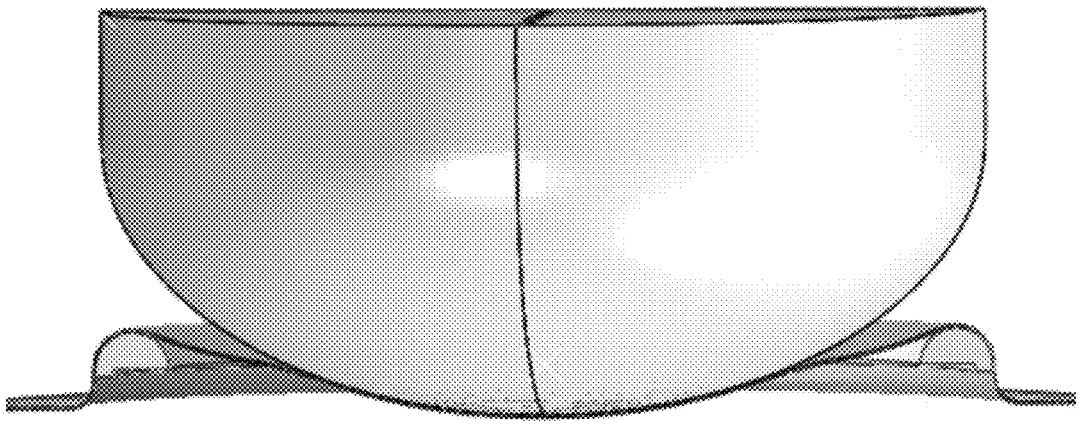
FIG. 11 is a first schematic diagram showing a working state in which the jacking ring of a first diameter is used to perform reverse bulging deformation on a sheet according to an embodiment of the present invention.
Figure 12:
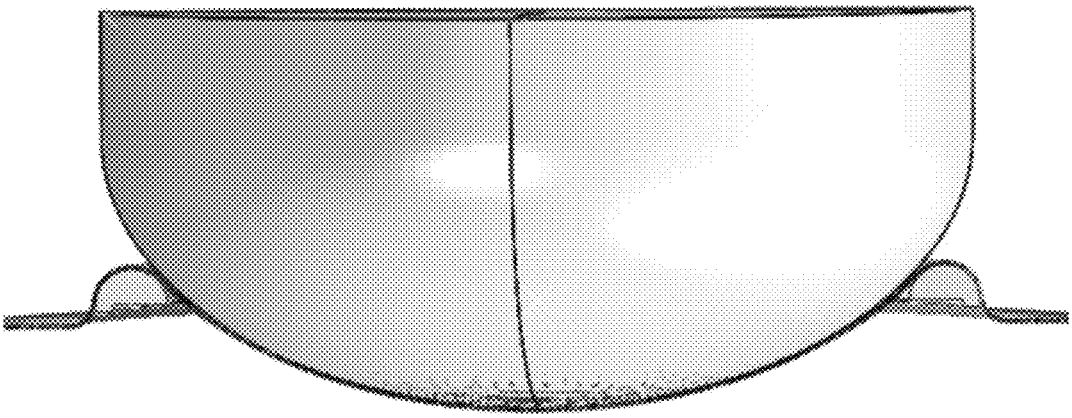
FIG. 12 is a second schematic view showing a working state in which the jacking ring of the first diameter is used to perform reverse bulging deformation on the sheet according to an embodiment of the present invention.
Figure 13:
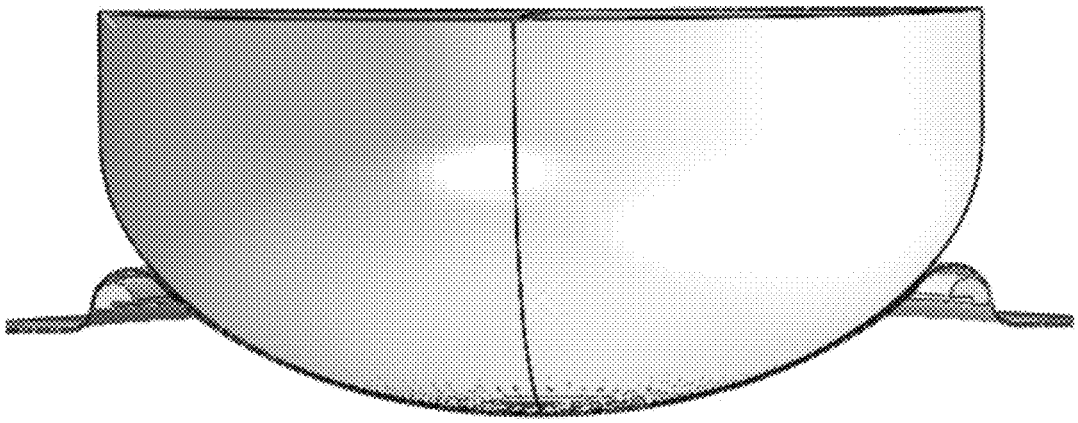
FIG. 13 is a first schematic diagram showing a working state in which the jacking ring of a second diameter is used to perform reverse bulging deformation on a sheet according to an embodiment of the present invention.
Figure 14:
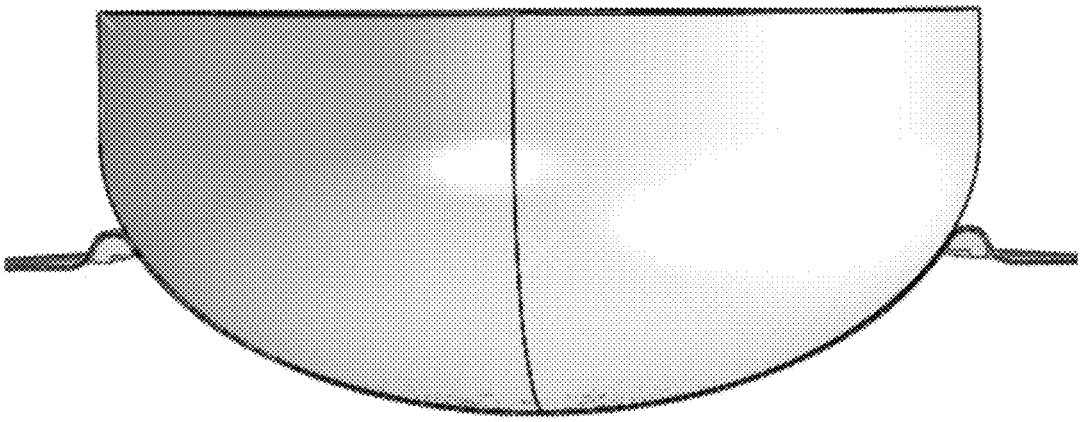
FIG. 14 is a second schematic view showing a working state in which the jacking ring of the second diameter is used to perform reverse bulging deformation on the sheet according to an embodiment of the present invention.
Figure 15:
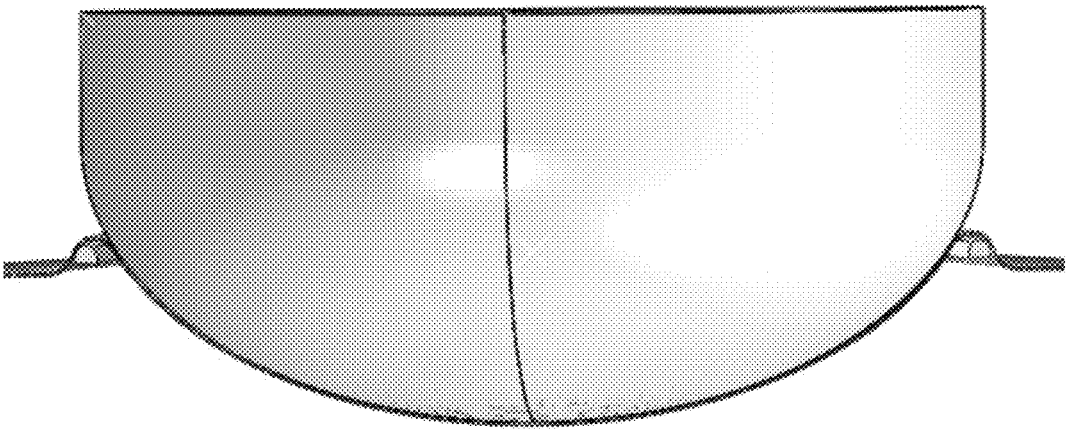
FIG. 15 is a first schematic diagram showing a working state in which the jacking ring of a third diameter is used to perform reverse bulging deformation on a plate according to an embodiment of the present invention.
Figure 16:
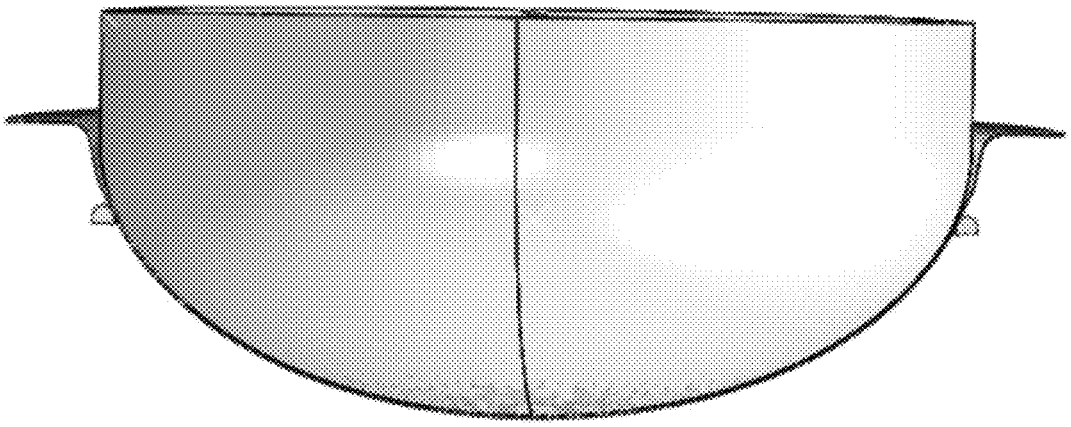
FIG. 16 is a second schematic view showing a working state in which the jacking ring of a third diameter is used to perform reverse bulging deformation on the sheet according to an embodiment of the present invention.

FIGS. 11 to 16, wherein FIGS. 11 and 12 are schematic views showing a working state in which a jacking ring of a first diameter is used for performing reverse bulging deformation on a sheet, FIGS. 13 and 14 are schematic views showing a working state in which a jacking ring of a second diameter is used for performing reverse bulging deformation on a sheet, and FIGS. 15 and 16 are schematic views showing an working state in which a jacking ring of a third diameter is used for performing reverse bulging deformation on a sheet. It is to be noted that the three diameters of the jacking ring in the embodiment satisfy a relationship, i.e., first diameter>second diameter>third diameter.

In Example 2, three jacking rings of different diameters are selected to perform reverse bulging deformation on the sheet at different drawing stages, and a reduction rate of the finished large-sized thin-wall curved surface part is 10.81%. It can be seen that by adjusting the diameter of the jacking ring at different drawing stages, a resultant part with a smaller reduction rate can be obtained.

Example 3

As shown in FIGS. 4 to 6, Example 3 provides an implementation process of drawing a thin-wall enclosure of a large dimension and with an opening diameter of 2250 mm at an ultra-low temperature of −160° C., which includes three stages, namely, an initial drawing stage of pre-cooling the blank to be drawn and the forming die 1, a stage of lifting the jacking ring 21 along with the process of drawing the upper die 11, and a stage of lowering the jacking ring 21 along with the process of drawing the upper die 11; herein, the blank to be drawn is a solution-anneal AA 2219 aluminum alloy, and the implementation process includes the steps as follows.

In step S1, the lower die 12 is fixed on the workbench surface of the press machine, the blank to be drawn is placed on the lower die 12, and the blank to be drawn is centered with the die cavity of the lower die 12.

In step S2, the blank holder 13 descends and presses the blank to be drawn, and a closed cavity is formed on the flange side of the blank to be drawn.

In step S3, the lower die 12 and the blank holder 13 are cooled by filling the lower die 12 and the blank holder 13 with liquid nitrogen to obtain a lower die temperature from −180° C. to −190° C.; meanwhile, the liquid nitrogen is sprayed on the upper and lower surfaces of the blank flange to be drawn through the first cooling channel 123 of the lower die 12 and the second cooling channel 132 of the blank holder 13 to obtain a critical temperature of −160° C. for drawing.

In step S4, a blank-holder force is applied to the blank holder 13, and the upper die 11 is lowered to contact the blank to be drawn.

In step S5, the power unit 3 pushes two transverse pulleys 25 and two transverse guide bars 23 to move towards each other in direction X as shown in the drawings and then drives the longitudinal pulley 26 and the longitudinal guide bar 24 to move forwards in direction Y as shown in the drawings, and the jacking ring 21 is lifted so that the blank to be drawn contacts the jacking ring 21 and reversely deforms under the action of the jacking ring 21 to form the convex hull.

In step S6, liquid nitrogen is sprayed on the upper surface of the convex hull through the third channel of the blank holder 13 so that the temperature at the position of the convex hull is always below −160° C., the blank is reinforced and plasticized locally, and local cracking caused by reverse bulging at the position is avoided.

In step S7, the blank-holder force is continuously applied to the blank holder 13, the upper die 11 is further lowered, the power unit 3 pulls two transverse pulleys 25 and two transverse guide bars 23 to move oppositely in direction X as shown in the drawings and then drives the longitudinal pulley 26 and the longitudinal guide bar 24 to move backwards in direction Y as shown in the drawings so that the jacking ring 21 is lowered along with the upper die 11, and the convex hull is gradually reduced in shape.

In step S8, the upper die 11 is lowered further, and the jacking ring 21 is lowered accordingly under the control of the power unit 3 until the blank to be drawn experiences the formation.

In step S9, the cooling unit is closed, the supply of liquid nitrogen into the forming die 1 is stopped, the power unit 3 is unloaded, the lower die 12 and the blank holder 13 returns, and the resultant part is taken out.

Although the present disclosure has been described above, the scope of the present disclosure is not limited thereto. Various changes and modifications may be made by those skilled in the art without departing from the spirit and scope of the present disclosure, and such changes and modifications are intended to fall within the scope of the present disclosure.

The invention claimed is:

1. An apparatus for deep drawing of large-sized thin-wall curved surface parts with servo reverse bulging, comprising:

a forming die, a jacking unit, and a power unit, wherein:

the forming die comprises an upper die, a lower die and a blank holder, the upper die and the blank holder are connected to a press machine, the press machine drives the upper die and the blank holder to move, the lower die is fixed on a workbench surface of the press machine, the blank holder is disposed above the lower die, and a blank to be drawn is placed between the lower die and the blank holder; the jacking unit is disposed inside the lower die and is adapted to move along a moving direction of the upper die to deform the blank to be drawn;

the lower die is fixed on the workbench surface of the press machine by a lower die fixing plate and a lower die support, a first end of the jacking unit is extended into a die cavity of the lower die, and a second end of the jacking unit is driven by the power unit to move on the lower die fixing plate.

2. The apparatus for deep drawing of large-sized thin-wall curved surface parts with servo reverse bulging according to claim 1, wherein the jacking unit comprises a jacking ring and a guide portion which are connected to each other, the jacking ring is extended into the die cavity of the lower die and contacts the blank to be drawn, the guide portion is connected to the power unit, and the power unit is adapted to power the guide portion and drive the guide portion and the jacking ring to move.

3. The apparatus for deep drawing of large-sized thin-wall curved surface parts with servo reverse bulging according to claim 2, wherein the guide portion comprises a first guide mechanism connected to the jacking ring and two second guide mechanisms connected to the power unit, the first guide mechanism and the second guide mechanisms move in perpendicular directions, and the first guide mechanism is movably connected to the second guide mechanisms.

4. The apparatus for deep drawing of large-sized thin-wall curved surface parts with servo reverse bulging according to claim 3, wherein both of the second guide mechanisms are rotatably connected to the first guide mechanism, both of the second guide mechanisms are arranged on both sides of the first guide mechanism, respectively, and both of the second guide mechanisms move in opposite directions.

5. The apparatus for deep drawing of large-sized thin-wall curved surface parts with servo reverse bulging according to claim 3, wherein the first guide mechanism includes a longitudinal guide bar and a longitudinal pulley, the longitudinal guide bar is connected to the jacking ring, and the longitudinal pulley is used for connecting the longitudinal guide bar and the second guide mechanisms; each of the second guide mechanisms includes a transverse guide bar and a transverse pulley, a first end of the transverse guide bar is connected to the longitudinal guide bar through the transverse pulley, and a second end of the transverse guide bar is connected to the power unit through the longitudinal pulley.

6. The apparatus for deep drawing of large-sized thin-wall curved surface parts with servo reverse bulging according to claim 3, wherein the power unit comprises a hydraulic station and a hydraulic cylinder which are connected to each other, and the hydraulic cylinder is connected to the second guide mechanisms.

7. The apparatus for deep drawing of large-sized thin-wall curved surface parts with servo reverse bulging according to claim 2, wherein a contact end of the jacking ring with the blank to be drawn is provided with a rubber ring.

8. The apparatus for deep drawing of large-sized thin-wall curved surface parts with servo reverse bulging according to claim 1, further comprising a cooling unit, a first cooling cavity communicating with the cooling unit is provided in the lower die, and a second cooling cavity communicating with the cooling unit is provided in the blank holder; the first cooling cavity and/or the second cooling cavity are adapted to convey a cooling medium to the blank to be drawn.

9. The apparatus for deep drawing of large-sized thin-wall curved surface parts with servo reverse bulging according to claim 8, wherein the cooling unit comprises a cold source and a temperature control element, the cold source is communicating with the forming die through a pipeline, and the temperature control element is disposed on the pipeline.

10. The apparatus for deep drawing of large-sized thin-wall curved surface parts with servo reverse bulging according to claim 8, wherein a contact end of the lower die with the blank to be drawn is provided with a first cooling channel communicating with the first cooling cavity, and/or a contact end of the blank holder with the blank to be drawn is provided with a second cooling channel communicating with the second cooling cavity.

11. The apparatus for deep drawing of large-sized thin-wall curved surface parts with servo reverse bulging according to claim 10, wherein an inner end of the blank holder is provided with a third cooling channel communicating with the second cooling cavity, and the inner end of the blank holder is adjacent to the contact end of the blank holder with the blank to be drawn.

12. A method for deep drawing of large-sized thin-wall curved surface parts with servo reverse bulging by an apparatus comprising a forming die, a jacking unit, and a power unit, wherein the forming die comprises an upper die, a lower die and a blank holder, the upper die and the blank holder are connected to a press machine, the press machine drives the upper die and the blank holder to move, the lower die is fixed on workbench surface of the press machine, the blank holder is disposed above the lower die, and a blank to be drawn is placed between the lower die and the blank holder; the jacking unit is disposed inside the lower die and is adapted to move along a moving direction of the upper die to deform the blank to be drawn, the method comprising the steps of:

step T1: fixing the lower die of the forming die on the workbench surface of the press machine, while placing the blank to be drawn on the lower die, and centering the blank to be drawn with the die cavity of the lower die;

step T2: lowering the blank holder to press the blank to be drawn, and forming a closed cavity on a flange side of the blank to be drawn;

step T3: applying a blank-holder force to the blank holder, and lowering the upper die to contact the blank to be drawn;

step T4: lifting the jacking unit upwards to contact the blank to be drawn, and enabling the blank to be drawn to deform reversely to form a convex hull;

step TS: continuously applying the blank-holder force to the blank holder, and lowering the upper die further with the jacking unit lowered together so that gradually the convex hull reduces in shape;

step T6: lowering the upper die even further with the jacking unit lowered accordingly until the blank to be drawn experiences the formation; and step T7: unloading the power unit of the jacking unit, returning the lower die and the blank holder, and taking out a resultant part.

13. A method for deep drawing of large-sized thin-wall curved surface parts with servo reverse bulging by an apparatus comprising a forming die, a jacking unit, and a power unit, wherein the forming die comprises an upper die, a lower die and a blank holder, the upper die and the blank holder are connected to a press machine, the press machine drives the upper die and the blank holder to move, the lower die is fixed on a workbench surface of the press machine, the blank holder is disposed above the lower die, and a blank to be drawn is placed between the lower die and the blank holder; the jacking unit is disposed inside the lower die and is adapted to move along a moving direction of the upper die to deform the blank to be drawn, the apparatus further comprising a cooling unit, a first cooling cavity communicating with the cooling unit being provided in the lower die, and a second cooling cavity communicating with the cooling unit being provided in the blank holder, wherein the method comprises the steps of:

step S1: fixing the lower die of the forming die on the workbench surface of the press machine, while placing the blank to be drawn on the lower die, and centering the blank to be drawn with the die cavity of the lower die;

step S2: lowering the blank holder to press the blank to be drawn, and forming a closed cavity on a flange side of the blank to be drawn;

step S3: filling the lower die and the blank holder with the cooling medium to cool the lower die and the blank holder, and spraying the cooling medium on upper and the lower surfaces of the flange side of the blank to be drawn through the first cooling channel of the lower die and the second cooling channel of the blank holder to obtain a critical temperature for drawing;

step S4: continuously applying the blank-holder force to the blank holder, and lowering the upper die to contact the blank to be drawn;

step S5: lifting the jacking unit upwards to contact the blank to be drawn, and enabling the blank to be drawn to deform reversely to form a convex hull;

step S6: spraying the cooling medium on an upper surface of the convex hull through a third channel of the blank holder so that a temperature of the convex hull is always below a critical temperature;

step S7: continuously applying the blank-holder force to the blank holder, and lowering the upper die further with the jacking unit lowered together so that gradually the convex hull reduces in shape;

step S8: lowering the upper die even further with the jacking unit lowered accordingly until the blank to be drawn experiences the formation; and step S9: stopping a supply of the cooling medium, unloading the power unit of the jacking unit, returning the lower die and the blank holder, and taking out a resultant part.

14. The method for deep drawing of large-sized thin-wall curved surface parts with servo reverse bulging according to claim 13, wherein the cooling medium includes liquid oxygen, liquid argon, or liquid nitrogen.

* * * * *